US008006706B2

(12) United States Patent
Sekine

(10) Patent No.: US 8,006,706 B2
(45) Date of Patent: Aug. 30, 2011

(54) VANITY CASE

(75) Inventor: Masayuki Sekine, Tokyo (JP)

(73) Assignee: Yoshida Industry Co., Ltd., Tokyo (JP)

( * ) Notice: Subject to any disclaimer, the term of this patent is extended or adjusted under 35 U.S.C. 154(b) by 420 days.

(21) Appl. No.: 12/296,581

(22) PCT Filed: Feb. 13, 2008

(86) PCT No.: PCT/JP2008/052307

§ 371 (c)(1),
(2), (4) Date: Oct. 9, 2008

(87) PCT Pub. No.: WO2008/099833

PCT Pub. Date: Aug. 21, 2008

(65) Prior Publication Data

US 2009/0165813 A1 Jul. 2, 2009

(30) Foreign Application Priority Data

Feb. 16, 2007 (JP) ..... 2007-035917

(51) Int. Cl.
*A45D 33/00* (2006.01)
*A45D 33/22* (2006.01)

(52) U.S. Cl. ..... 132/293; 132/295

(58) Field of Classification Search ..... 132/293–297, 132/300; 220/830; 206/581, 823
See application file for complete search history.

(56) References Cited

U.S. PATENT DOCUMENTS

| | | | | |
|---|---|---|---|---|
| 6,857,538 | B2 * | 2/2005 | Lin | 220/830 |
| 7,441,309 | B2 * | 10/2008 | Suzuki et al. | 16/330 |
| 2003/0173369 | A1 * | 9/2003 | Nikolaus et al. | 220/830 |
| 2007/0181575 | A1 | 8/2007 | Yamanaka | |

FOREIGN PATENT DOCUMENTS

| | | |
|---|---|---|
| JP | 7-44246 | 10/1995 |
| JP | 2003-335 | 1/2003 |
| JP | 2003-339428 | 12/2003 |
| JP | 2006-36263 | 2/2006 |

OTHER PUBLICATIONS

International Search Report issued May 20, 2008 in the International (PCT) Application No. PCT/JP2008/052307.

* cited by examiner

*Primary Examiner* — Robyn Doan
(74) *Attorney, Agent, or Firm* — Wenderoth, Lind & Ponack L.L.P.

(57) ABSTRACT

A vanity case is provided in which a first hinge piece and a second hinge piece are formed in one of the case body and the lid, and a hinge block is formed in the other one of the case body and the lid and arranged between the first and the second hinge pieces. A friction member is provided to brake the rotational speed of the lid caused by a torsion spring. A protrusion is provided for braking the rotational speed of the lid by sliding contact. A recessed circumferential portion is formed in the vanity case so as to release the sliding contact of the braking protrusion at least at the closed position of the lid.

8 Claims, 4 Drawing Sheets

VANITY CASE

FIELD OF THE INVENTION

The present invention relates to a vanity case having a mechanism for controlling an opening speed of a lid which is pivotably mounted in a case body and is automatically opened.

BACKGROUND ART

As a technology of improving both usability and a sense of luxury by automatically opening a lid of a vanity case and controlling its opening speed, there is known a prior art disclosed in Japanese Patent Application Laid-open No. 2006-36263. In this prior art, a shaft (pin) disposed in a case body is inserted into a shaft holding portion provided at the lid, an urging means is provided for urging the lid in an opening direction, and viscous material is charged between the shaft and the shaft holding portion such that the lid is slowly opened with respect to the case body. In the above-mentioned case, the shaft holding portion provided at the lid can be rotated around the shaft in accordance with the opening operation of the lid, and at that time, the viscous material resists against the relative rotation between the shaft and the shaft holding portion, so that the speed of rotation of the lid due to the urging means is controlled.

DISCLOSURE OF THE INVENTION

Problems to be Solved by the Invention

However, since the technology disclosed in Japanese Patent Application Laid-open No. 2006-36263 is to charge the viscous material between the shaft and the shaft holding portion, it is necessary to secure a gap for charging the viscous material between the shaft and the shaft holding portion and to provide a seal member so as to prevent the charged viscous material from leaking outside, and thus the shapes of members such as the shaft and the shaft holding portion become complicated. Further, some steps, such as charging the viscous material and mounting the seal member, are also required, and much effort has to be introduced to assemble the case. Additionally, it is difficult to check as to whether the viscous material is charged as required, and it is not easy to control its quality. Therefore, the cost of production will be increased due to the complicated assembly.

The present invention is provided in consideration of the above problems of the prior art, and an object thereof is to provide a vanity case having a control mechanism for controlling an opening speed of the lid, in which shapes of members and mechanisms are simple, assembly is easy, and the cost of production can also be reduced.

Means for Solving the Problems

A vanity case according to the present invention comprises a case body containing a cosmetic material, a lid opening and closing an upper surface of the case body, a pair of a first hinge piece and a second hinge piece formed in one of the case body and the lid, a hinge block formed in the other one of the case body and the lid and arranged between the first and the second hinge pieces, and a hinge pin inserted through the hinge block and the hinge piece to pivotably couple the lid with the case body, wherein a torsion spring is provided at the first hinge piece side for urging the lid so as to rotate in an opening direction by engaging the torsion spring with the case body and the lid; a convex portion is formed in one of the second hinge piece and the hinge block facing the second hinge piece; a concave portion is formed in the other of the second hinge piece and the hinge block facing to the second hinge piece so that the convex portion can be inserted therein; a friction member is provided in the concave portion to brake the rotational speed of the lid due to the torsion spring by holding the friction member under pressure between the concave portion and the convex portion; a protrusion is provided on one of an outer circumference of the convex portion and an inner circumference of the concave portion for braking the rotational speed of the lid by sliding contact with the other one of the outer circumference of the convex portion and the inner circumference of the concave portion; and a recessed circumferential portion is formed between the outer circumference of the convex portion and the inner circumference of the concave portion so as to release the sliding contact of the braking protrusion at least at the closed position of the lid.

Preferably, the convex portion is formed in a cylindrical shape, the braking protrusion is formed so as to protrude radially outward from the cylindrical convex portion, and the concave portion has an arc-shaped inner circumferential wall to which the recessed circumferential portion is formed in succession therewith.

Additionally, it is preferable that the convex portion has an arc-shaped outer circumferential wall to which the recessed circumferential portion is formed in succession therewith, and the concave portion has an arc-shaped inner circumferential wall to which the braking protrusion is formed toward the center of the inner circumferential wall.

Additionally, it is preferable that the first hinge piece and the second hinge piece are formed on the case body, and the hinge block is formed on the lid.

Additionally, it is preferable that the concave portion is formed at the side surface of the hinge block with a partial cutout being provided toward the lower end of the hinge block, and the convex portion is formed on the second hinge piece so that the convex portion can be inserted to the concave portion through the cutout.

Additionally, it is preferable that the friction member comprises an O-ring made of a rubber material or synthetic resin material, which is elastically deformable.

REFERENCE NUMBERS

Figure 1:
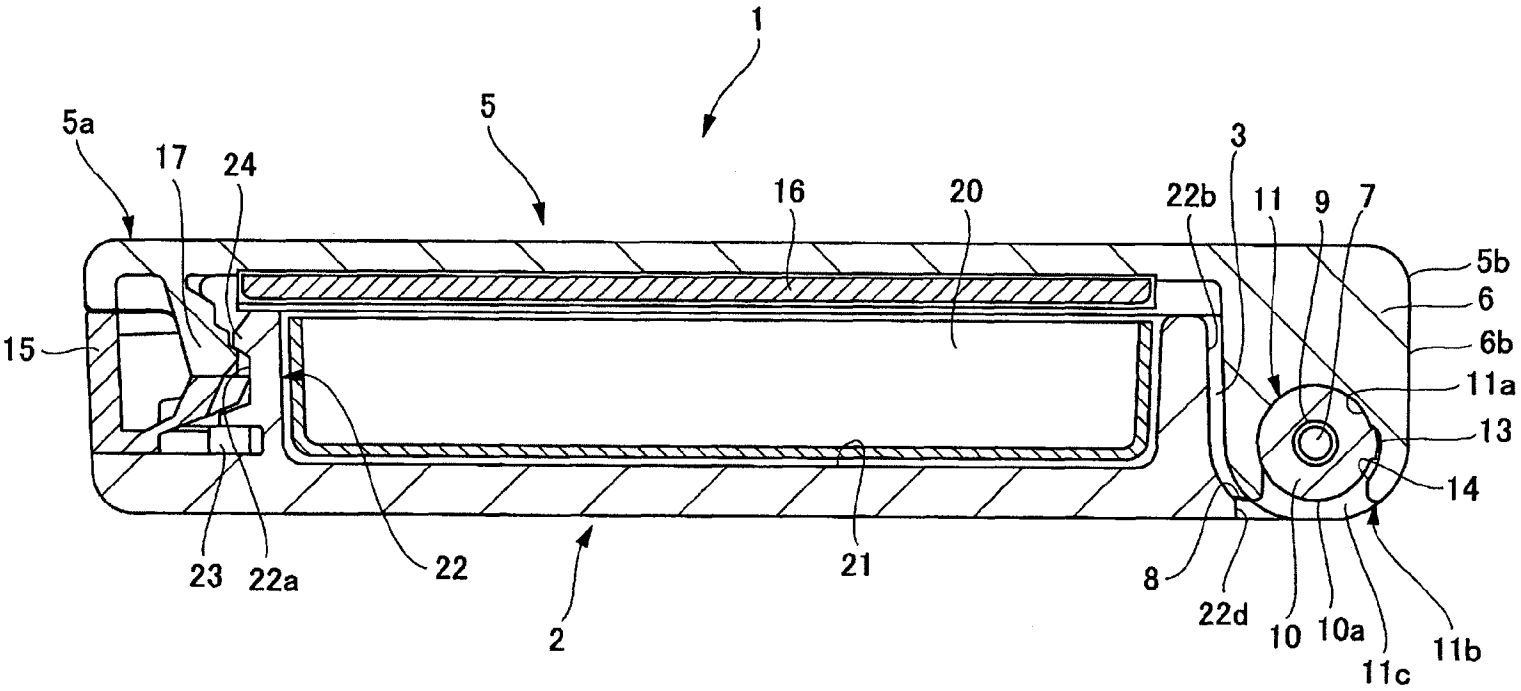
FIG. 1 is a longitudinal sectional view of a preferred embodiment of a vanity case according to the present invention.
Figure 2:
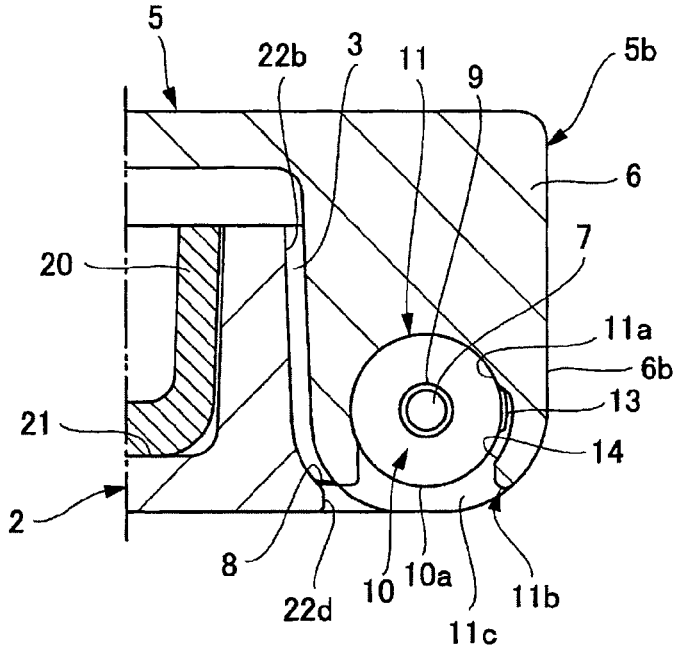
FIG. 2 is an enlarged longitudinal sectional view of a rear portion of the vanity case of FIG. 1.
Figure 3:
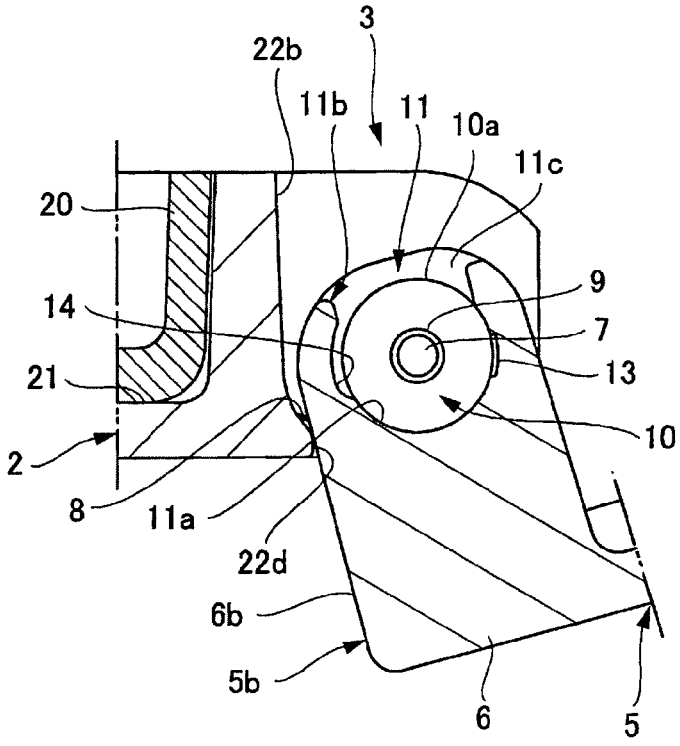
FIG. 3 is an enlarged longitudinal sectional view of a rear portion of the vanity case of FIG. 1, with a lid being open to the maximum position.

1 vanity case
2 case body
3 first hinge piece
4 second hinge piece

5 lid
6 hinge block
7 hinge pin
8 torsion spring
10 convex portion
11 concave portion
12 friction member
13 braking protrusion
14 recessed circumferential portion

DETAILED DESCRIPTION OF THE INVENTION

In the following, a preferred embodiment of a vanity case according to the present invention is described in detail with reference to the accompanying drawings. As shown in FIGS. 1 to 6, a vanity case 1 according to the present embodiment basically comprises a lid 5 which is hinged to a case body 2 in an openable/closable manner.

The case body 2 is made of synthetic resin material, and a circumferential wall 22 defining a container recess 21 is formed in which a cosmetic plate 20 is contained. A front concave portion 23 is formed at the center of a front surface portion 22*a* of the circumferential wall 22. A hook protrusion 24 is provided as projected from the front surface portion 22*a* in the front concave portion 23 so that the lid 5 can be locked in the case body 2. A push piece 15 is slidably mounted in the front concave portion 23. At a back surface portion 22*b* of the circumferential wall 22, a first hinge piece 3 and a second hinge piece 4 are integrally formed with the case body 2 so as to protrude backward from the left and right sides thereof. The first hinge piece 3 and the second hinge piece 4 each has a hinge pin hole 9 laterally penetrating therethrough. Further, there is provided a back surface protruding portion 22*d* projecting backward at the lower side of the back surface portion 22*b* between the first hinge piece 3 and the second hinge piece 4.

The lid 5 is made of synthetic resin material, and a mirror plate 16 is mounted on an undersurface thereof. An outline of the lid 5 in a plan view is formed substantially the same as that of the case body 2 so that the undersurface of the lid 5 comes into contact with the upper end of the circumferential wall 22 of the case body 2 when the lid 5 is closed on the case body 2. Thereby, the front concave portion 23 of the case body 2 is covered with a front end 5*a* of the lid 5. A hook piece 17 inclining slightly backward and downward from the lower front end of the lid is formed opposing the front surface portion 22*a* of the case body 2. A rear end portion of the hook piece 17 is engaged with the hook protrusion 24 at the front surface of the case body 2. A hinge block 6 is integrally formed to extend downward from the center of the undersurface of the lid 5 so that the hinge block 6 locates between the hinge pieces 3 and 4 of the case body 2.

Figure 4:
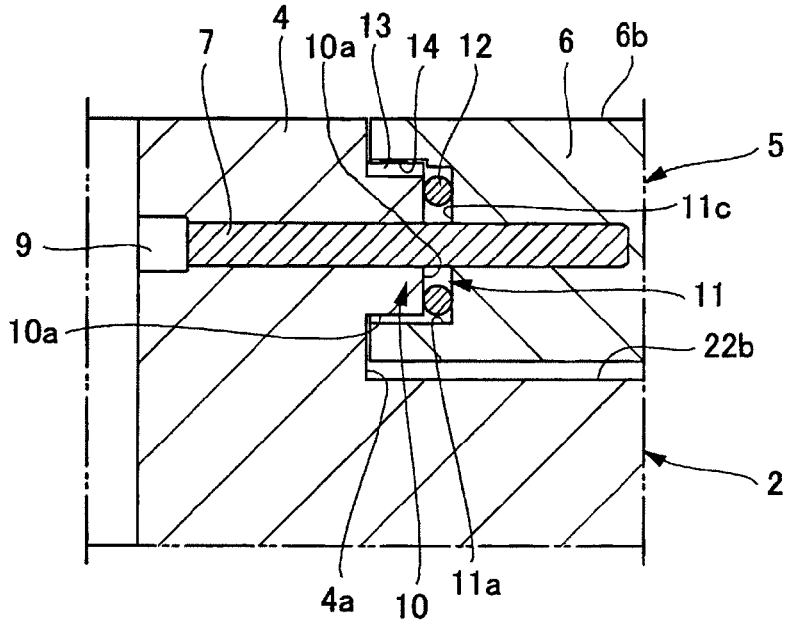
FIG. 4 is a horizontal sectional view showing an arrangement of a second hinge piece and a hinge block of the vanity case of FIG. 1.
Figure 5:
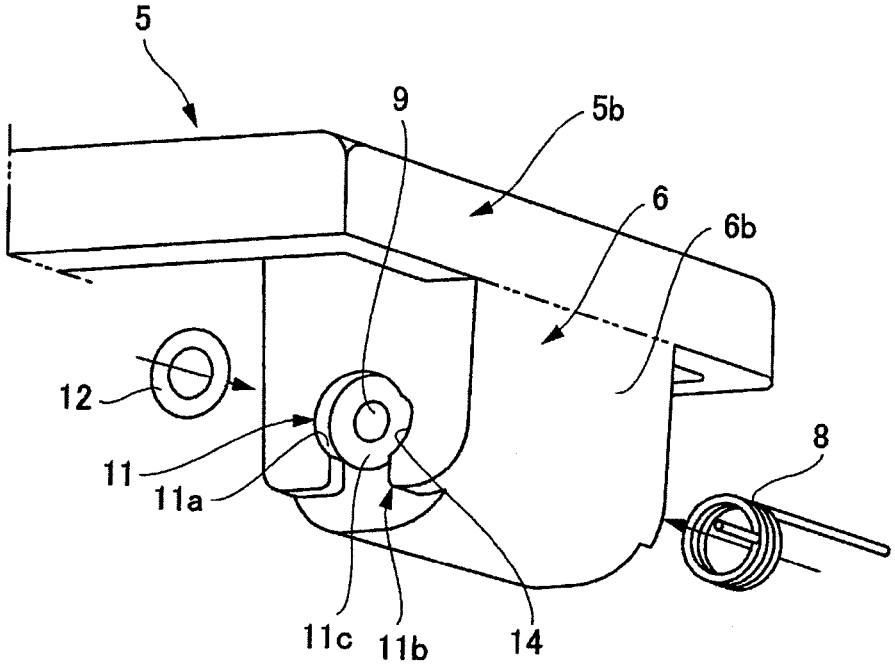
FIG. 5 is a perspective view showing an assembly of a friction member and a torsion spring with the hinge block of the vanity case of FIG. 1.
Figure 6:
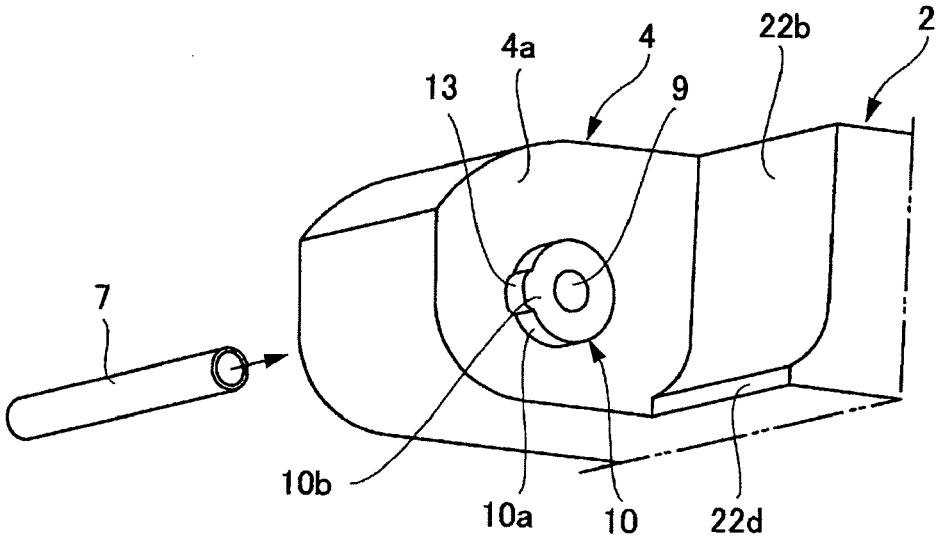
FIG. 6 is a perspective view showing a relationship between the second hinge piece and a hinge pin of the vanity case of FIG. 1.

The hinge block 6 has two hinge pin holes 9 provided laterally from the center of the hinge block toward both right and left sides respectively. The hinge pin hole 9 at the left side of the hinge block 6 laterally communicates with another hinge pin hole 9 of the second hinge piece 4 at the left side of the case body 2 as shown in FIG. 4 to insert the hinge pin 7 from left side. Likewise, the hinge pin hole 9 at the right side of the hinge block 6 laterally communicates with another hinge pin hole 9 of the first hinge piece 3 at the right side of the case body to insert the hinge pin 7 from right side. By inserting the hinge pins 7 and 7, the lid 5 is pivotably coupled to the case body 2. Both lower corners of the hinge block 6 are formed along a circular contour so that an upper surface of a backward protruding portion 22*d* of the case body 2 is formed along the same circular contour. Thereby, when the lid 5 rotates, the backward protruding portion 22*d* of the case body 2 does not contact with the corner of the undersurface of the hinge block 6. On the other hand, when the lid 5 is open to the maximum position, the backward protruding portion 22*d* comes into contact with a back surface portion 6*b* of the hinge block 6 and acts as a stopper to control the maximum opening of the lid 5.

A torsion spring 8 is provided between the first hinge piece 3 and the hinge block 6 so that the lid 5 is urged to rotate in an opening direction. The torsion spring 8 is comprised of copper windings and is contained in a concave portion (not shown) of the hinge block 6, which is opposite to the first hinge piece 3. The concave portion is formed in a cylindrical shape around the hinge pin hole 9 so that the hinge pin 7 is inserted inside of the torsion spring which is set in the concave portion.

An end of the torsion spring 8 on the hinge block 6 side is extended in a direction of an axis of the hinge pin 7 and is inserted into a hole (not shown) formed on the interior surface of the concave portion. The other end of the torsion spring 8 on the first hinge piece 3 side is extended in a tangential direction thereof, which is a direction perpendicular to the hinge pin 7, and fixed to a portion (not shown) formed at the back surface portion 22*b* of the case body 2. By fixing the both ends of the torsion spring 8 as set forth above, the lid 5 is urged in the opening direction. The urging force of the torsion spring 8 is maximized in the closed position of the lid 5, and is adjusted so as to maintain the urging force when the lid 5 is rotating toward the maximum open position. The strength of the urging force is determined in consideration of a shape and weight of the lid 5, and a friction resistance when the lid 5 is rotating.

On a surface of the hinge block 6 opposing to the second hinge piece 4 of the hinge block 6, a concave portion 11 is formed in a cylindrical shape around the hinge pin hole 9. On an interior surface 11*c* of the concave portion 11, a friction member 12 which brakes the rotational speed of the lid 5 against the torsion spring 8 is mounted in an elastically deformable manner between an end portion 10*b* of a convex portion 10 and the interior surface 11*c* of the concave portion 11 such that the friction member 12 is held under pressure by deforming the thickness thereof. The friction member 12 according to the present embodiment comprises an O-ring made of an elastically deformable rubber or synthetic resin. The friction member 12 is elastically deformed as pressed between the end portion 10*b* of the convex portion 10 and the interior surface 11*c* of the concave portion 11 so that the friction resistance is generated, whereby the rotational speed of the lid 5 urged in the opening direction by the torsion spring 8 can be adjusted. By changing the substance of the friction member 12, the smoothness of the surface thereof, and the area of the friction material contacting with the second hinge piece 4 and the hinge block 6, the rotational friction between the lid 5 and the case body 2 can be adjusted.

On a surface 4*a* of the second hinge piece 4 which is opposite to the hinge block 6, there is provided a convex portion around the hinge pin hole 9. A braking protrusion 13 is formed by radially and outwardly extending a portion of the outer circumference 10*a* of the convex portion 10. The braking protrusion 13 is adapted to slide in contact with an inner circumference 11*a* of the concave portion 11 so as to generate the frictional resistance therebetween and to brake the rotational speed of the lid 5. By changing the size, width or length of the braking protrusion 13, the pressing force of the protrusion 13 against the concave portion 11 as well as the contact area of the protrusion upon the concave portion 11 are changed, so that it becomes possible to adjust the frictional resistance. Here, it is to be noted that the pressing force caused by the elastic deformation of the friction member 12 between the convex portion 10 and the concave portion, is a main factor to adjust the frictional resistance.

By adjusting the frictional forces caused by the friction member 12 and the braking protrusion 13 in consideration of the magnitude of the urging force of the torsion spring 8, it is possible to adjust the rotational force of the lid 5 and the opening speed thereof.

At the lower part of the concave portion 11, a cutout 11*b* is formed so that the convex portion 10 is inserted and fitted into the concave portion 11. A width of the cutout of the concave portion 11 is configured to be slightly smaller than an outer diameter of the convex portion 10 such that the convex portion 10 can be inserted into the concave portion 11 and does not fall off easily after the insertion. When the convex portion 10 is to be inserted into the concave portion 11, the both portions are elastically deformed to allow the insertion.

A part of the inner circumference 11*a* of the concave portion 11 is deformed to expand outwardly in the radial direction to form a recessed circumferential portion 14. The recessed circumferential portion 14 is provided in adjacent to the cutout 11*b* so as to enclose the braking protrusion 13 while the lid 5 is being closed. When the braking protrusion 13 is positioned in the recessed circumferential portion 14, the sliding contact between the braking protrusion 13 and the inner circumference 11*a* does not occur, so that the braking caused by the braking protrusion 13 against the torsion spring 8 does not occur as well. Since the recessed circumferential portion 14 is formed in the area enclosing the braking protrusion 13 while the lid 5 is being closed, the friction resistance of the braking protrusion 13 does not occur at the beginning of the opening action of lid 5 where a strong urging force is necessary, so that the lid 5 can be opened smoothly.

The action of the vanity case 1 according to the present embodiment will be described. The torsion spring 8 is mounted in the concave portion while inserting its one end portion into the hole of the lid, and the friction member 12 is mounted on the interior surface 11*c* in the concave portion 11 of the hinge block 6. The lid 5 is mounted on the case body 2 from its above by inserting the convex portion 10 into the concave portion 11 through the cutout 11*b*. Since the convex portion 10 is inserted such that the braking protrusion 13 can be enclosed by the recessed circumferential portion 14 of the concave portion 11, there is no friction between the protrusion 14 and the inner circumference 11*a*. In parallel with this operation, the other end of the torsion spring 8 is engaged with the case body so as to provide spring force to the lid in the closed position. Also, the lid 5 is provided with the friction resistance for rotation as the friction member 12 is fitted under pressure between the convex portion 10 and the concave portion 11. Then, the hinge pin hole 9 of the first and second hinge piece 3 and 4 of the case body 2 are communicated with the hinge pin hole 9 of the hinge block 6 so that the hinge pin 7 is inserted. Thereby, the lid 5 can be mounted on the case body 2 and urged in the opening direction by the torsion spring 8.

To open the lid 5 of the vanity case 1, the push piece 15 of the front concave portion 23 of the case body 2 is pushed backward. Then, the hook piece 17 is pushed up upwardly, and the lock is released by disengaging the end of the hook piece 17 from the hook protrusion 24. The lid 5 starts to rotating in the opening direction automatically due to the urging force of the torsion spring 8 against the weight of the lid 5 and the friction resistance of the friction member 12. In the opening action of the lid 5, the opening speed is adjusted by the friction resistance caused by the friction member 12 and the braking protrusion 13 so as not to open rapidly due to the urging force of the spring which accelerates the lid 5.

Since the braking protrusion 13 is positioned in the recessed circumferential portion 14 at the time of starting of the opening action of the lid 5, the friction resistance of the braking protrusion 13 does not occur. However, soon after the opening action of the lid 5, the braking protrusion 13 comes to contact with the inner circumference 11*a* to generate the friction resistance. As the opening of the lid 5 becomes wider, the urging force of the torsion spring 8 is reduced. Meanwhile, since a moment around the hinge pin 7 due to the weight of the lid 5 is also reduced at the same time, the opening action of the lid 5 becomes stable. On the other hand, the friction resistances generated by the friction member 12 and the braking protrusion 13 are maintained as constant regardless of the opening of the lid 5 so as to control the rotational speed. Consequently, the automatic opening action of the lid 5 whose opening speed is kept constant and slow becomes possible. In this way, the friction resistance generated by the friction member 12 and the braking protrusion 13 act as braking forces against the urging force of the torsion spring 8, so that the rapid opening action is prevented, and the opening speed of the lid 5 is controlled.

The opening action of the lid 5 is stopped when the back surface portion 6*b* of the hinge block 6 comes to contact with the back surface protruding portion 22*d* of the case body 2. At this stage, even when the opening action of the lid 5 is completed, the urging force of the torsion spring 8 is maintained for urging the lid 5 in the opening direction. Consequently, the back surface portion 6*b* of the hinge block 6 is still pushed to the back surface protruding portion 22*d* of the case body 2, so that the lid 5 is stably held in the full open state.

When the lid 5 is to be set to a closed state, the lid 5 is pushed down against the urging force of the torsion spring 8 and the resistances of the friction member 12 and the braking protrusion 13 so as to rotate the lid 5 in the closing direction. Due to the rotation of the lid, the hook piece 17 of the lid 5 is inserted into the front concave portion 23 of the case body 2, the undersurface of the lid 5 comes to contact with an upper end of the circumferential wall 22 of the case body 2, and the end portion of the hook piece 17 is engaged with the hook protrusion 24 so as to held a closed position of the lid 5.

As described above, in the vanity case 1 according to the present embodiment, the lid 5 rotates in the opening direction automatically by the urging force of the torsion spring 8, and then its opening speed is adjusted by the friction member 12 and the braking protrusion 13, so that the lid 5 is opened at a stable and slow speed from the starting of the opening action. In this way, a sense of high quality will be given to the vanity case.

A control mechanism for adjusting the opening speed of the lid 5 according to the present embodiment comprises the torsion spring 8 which urges the lid 5, the friction member 12 and the braking protrusion 13 for braking the urging force, the inner circumference 11*a*, the recessed circumferential portion 14 and the like, so that the mechanism and shapes of members are simple, assembly is easy, and the cost for production can be reduced.

Further, even if the torsion spring 8 has a high urging force, the opening speed of the lid 5 can be adjusted as required because the double braking means comprising the friction member 12 and the braking protrusion 13 can adjust the braking force caused by these means and the urging force of the torsion spring 8. Thereby, although the strong urging force is given to the torsion spring to secure the opening action of the lid, the strong braking force can stabilize the opening action of the lid and positively adjust the opening speed of the lid to a slow speed. Additionally, since there are provided a plurality of braking means against the urging force of the torsion spring 8, a fine adjustment of the opening speed becomes possible. For example, after the opening speed of the lid 5 is roughly adjusted by the weight of the lid 5 and the braking protrusion 13, precise adjustment of the opening speed of the lid can be made by the friction member 12.

Figure 7:
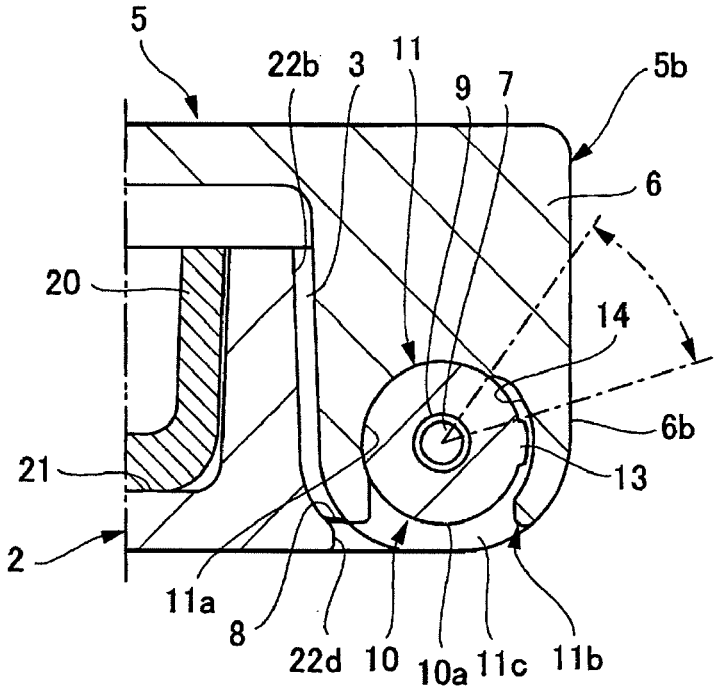
FIG. 7 is an enlarged longitudinal sectional view of a rear portion showing an alternative embodiment of the vanity case according to the present invention.

In the present embodiment, the recessed circumferential portion 14 of the concave portion 11 is formed at the lower end of the lid 5 so as to extend from the end of the cutout 11*b* to the position enclosing the braking protrusion 13 while the lid 5 is at the closed position. However, by extending this recessed circumferential portion 14 (see FIG. 7), the brake action caused by the braking protrusion 13 can be delayed so as to start braking after the opening action of the lid 5 is partly proceeded. In such a case, the opening action proceeds without being braked by the braking protrusion 13 at the initial step in which the speed of the opening action of the lid 5 is slow, and then a control acting takes place at the next step in which the opening action of the lid 5 will be accelerated.

In the above-mentioned embodiment, the first hinge piece and the second hinge piece are formed in the case body, and the hinge block is formed in the lid. However, on the contrary, the first hinge piece and the second hinge piece may be formed in the lid, and the hinge block may be formed in the case body.

Further, in the above-mentioned embodiment, the second hinge piece 4 includes the convex portion 10 having a cylindrical shape, and the hinge block 6 includes the concave portion 11 having the arc-shaped inner circumferential wall. However, on the contrary, the second hinge piece 4 may include the concave portion 11 having the arc-shaped inner circumferential wall, and the hinge block 6 may include the convex portion 10 having the cylindrical shape.

Further, in the above-mentioned embodiment, the braking protrusion 13 is formed on the convex portion 10, and the recessed circumferential portion 14 is formed in the concave portion 11. However, the braking protrusion 13 may be formed so as to protrude radially inward from the inner circumference 11*a* of the concave portion 11, and the recessed circumferential portion 14 may be formed by recessing the outer circumference 10*a* of the convex portion 10 radially inward. That is, the convex portion has an arc-shaped outer circumferential wall and a recessed circumferential portion in succession therewith, and the concave portion has an arc-shaped inner circumferential wall and a braking protrusion protruded radially toward the center of the circular inner circumferential wall.

As understood from the above description, in the vanity case according to the present invention, there is provided a control mechanism for adjusting the opening speed of the lid, in which shapes of members and mechanisms are simple, assembly is easy, and the cost of production can also be reduced.

The invention claimed is:

1. A vanity case, comprising:

a case body for containing a cosmetic material;

a lid for opening and closing an upper surface of the case body;

a first hinge piece and a second hinge piece, each of the first hinge piece and the second hinge piece being formed in one of the case body and the lid;

a hinge block formed in the other one of the case body and the lid and arranged between the first and the second hinge pieces;

a hinge pin inserted through the hinge block and one of the first hinge piece and the second hinge piece to pivotably couple the lid with the case body; and a friction member formed in the shape of an O-ring and made of a rubber material or a synthetic resin material, the friction member being elastically deformable, wherein a torsion spring is provided at the first hinge piece side of the case and engaging the case body and the lid for urging the lid to rotate in an opening direction;

wherein a convex portion is formed in one of the second hinge piece and the hinge block facing the second hinge piece;

wherein a concave portion is formed in the other of the second hinge piece and the hinge block facing the second hinge piece so that the convex portion can be inserted therein;

wherein the friction member is provided in the concave portion to brake the rotational speed of the lid due to the torsion spring by holding the friction member under pressure between the concave portion and the convex portion;

wherein a protrusion is provided on one of an outer circumference of the convex portion and an inner circumference of the concave portion for braking the rotational speed of the lid by sliding contact with the other one of the outer circumference of the convex portion and the inner circumference of the concave portion; and wherein a recessed circumferential portion is formed between the outer circumference of the convex portion and the inner circumference of the concave portion so as to release the sliding contact of the braking protrusion at least at the closed position of the lid.

2. The vanity case according to claim 1, wherein the convex portion is formed in a cylindrical shape, the braking protrusion is formed so as to protrude radially outward from the cylindrical convex portion, the concave portion has an arc-shaped inner circumferential wall, and the recessed circumferential portion is formed in the arc shaped inner circumferential wall of the concave portion.

3. The vanity case according to claim 1, wherein the convex portion has an arc-shaped outer circumferential wall, the recessed circumferential portion is formed in the arc shaped outer circumferential wall of the convex portion, and the concave portion has an arc-shaped inner circumferential wall to which the braking protrusion is formed extending toward the center of the inner circumferential wall.

4. The vanity case according to claim 1, wherein the first hinge piece and the second hinge piece are formed on the case body, and the hinge block is formed on the lid.

5. The vanity case according to claim 4, wherein the concave portion is formed at the side surface of the hinge block with a partial cutout being provided toward the lower end of the hinge block, and the convex portion is formed on the second hinge piece so that the convex portion can be inserted to the concave portion through the cutout.

6. The vanity case according to claim 1, wherein the friction member is elastically deformed between the concave portion and the convex portion such that the friction member provides a frictional force as the lid moves relative to the case body.

7. The vanity case according to claim 1, wherein the friction member has a thickness in a direction perpendicular to a radius of the O-ring shape, and the friction member is elastically deformed in a direction of the thickness thereof between the concave portion and the convex portion such that the friction member provides a frictional force as the lid moves relative to the case body.

8. The vanity case according to claim 1, wherein the convex portion has a face extending in a plane perpendicular to an axis of rotation of the lid, the face being on an end portion of the convex portion, and wherein the friction member is elastically deformed between the face of convex portion and the concave portion such that the friction member provides a frictional force as the lid moves relative to the case body.

* * * * *